US005558550A

United States Patent [19]

Setteducati

[11] Patent Number: 5,558,550

[45] Date of Patent: Sep. 24, 1996

[54] SIMULATED FINGER DEVICE

[76] Inventor: Mark Setteducati, 218 E. 17 St., New York City, N.Y. 10003

[21] Appl. No.: 195,588

[22] Filed: Feb. 14, 1994

[51] Int. Cl.[6] ..... A63H 37/00

[52] U.S. Cl. ..... 446/26; 446/236; 446/246; 446/390; 472/70; 472/133

[58] Field of Search ..... 446/26, 28, 236, 446/246, 390; 472/57, 69, 70, 133, 137, 51, 54, 55; D21/240, 241; 223/101; 2/21, 160, 163

[56] References Cited

U.S. PATENT DOCUMENTS

| | | | |
|---|---|---|---|
| 136,640 | 3/1873 | Bond | 2/21 |
| 203,978 | 5/1878 | Woods | 2/21 |
| 859,771 | 7/1907 | Holden | 223/101 |
| 869,686 | 10/1907 | Bauno | 472/51 |
| 1,010,283 | 11/1911 | Loy | 2/163 |
| 1,548,628 | 8/1925 | Petrie | 446/26 |
| 2,190,231 | 2/1940 | Craddock . | |
| 2,251,551 | 8/1941 | O'Reilly | 2/21 |
| 2,263,327 | 11/1941 | Bjerke et al. | 2/163 |
| 2,725,670 | 12/1955 | Hodes | 472/51 |
| 2,780,954 | 2/1957 | Bryce | 446/26 |
| 3,565,425 | 2/1971 | Breslow . | |
| 4,010,570 | 3/1977 | Kohler | 446/394 |
| 4,040,625 | 8/1977 | Malafronte | 446/236 |
| 4,161,082 | 7/1979 | Alexander | 446/390 |
| 4,280,695 | 7/1981 | Stenehjem et al. | 472/70 |
| 4,281,472 | 8/1981 | Hill | 446/26 |
| 4,304,065 | 12/1981 | Baiera | 472/70 |
| 4,315,650 | 2/1982 | Yoshida | 446/390 |
| 4,455,963 | 6/1984 | Matsuo | 446/26 |
| 4,507,804 | 4/1985 | Consigny | 2/163 |
| 4,658,445 | 4/1987 | Tribble | 2/163 |
| 4,684,354 | 8/1987 | Orenstein | 446/130 |
| 4,903,864 | 2/1990 | Sirhan | 446/26 |
| 5,071,114 | 12/1991 | Persaud et al. | 472/70 |
| 5,221,222 | 6/1993 | Townes | 446/26 |

FOREIGN PATENT DOCUMENTS

| | | | |
|---|---|---|---|
| 750292 | 8/1933 | France | 2/163 |

OTHER PUBLICATIONS

MacDonald & Co, Ali Bongo's Book of Magic "Thumb Fun" 1987 London England Peter Howarth, Magic Tricks 1989 (pp. 6 & 7).

Platt & Munk, Houdini's Magic, 1958 (p. 40).

Kevin James, Its Alive, 1992 Packaging, Illustration.

"Thumb Wrasslin manual", Imagination Inc. 1971.

*Primary Examiner*—Robert A. Hafer
*Assistant Examiner*—Jeffrey D. Carlson
*Attorney, Agent, or Firm*—Robert W. J. Usher

[57] ABSTRACT

A simulated finger is mounted for unnatural movement on a finger-ring structure so that the simulated finger appears to a casual observer to be the person's natural finger. In different examples, the movements are rotational or axial, and can expose a simulated bone and can be accompanied by appropriated sounds such as screeching or ratchetting. In another example, the simulated finger incorporated a whistle sounded by holding the tip of the simulated finger to the lips and blowing.

14 Claims, 8 Drawing Sheets

SIMULATED FINGER DEVICE

FIELD OF THE INVENTION

The invention relates to a simulated finger device for mounting on a person's finger to provide the fleeting illusion that the person' natural finger is performing an unexpected and unnatural movement or function.

BACKGROUND OF THE INVENTION

Several finger tricks involving the illusion of unexpected and unnatural finger movements are well known and can produce shocking delight and fascination in the casual observer. For example, the illusion of a person's thumb separating or breaking in two may be produced by placing the crooked or bent thumbs of each hand in abutment so that one forms a continuation of the other and both appear as one while masking the join with the fingers of one hand and moving the hands apart.

Another common trick is to stuff an empty or stuffed glove in a sleeve so that the glove is pulled off when shaking hands or to omit a finger from one digit to provide a floppy finger effect.

Other theatrical tricks include appearing one-legged by wearing a peg-leg fastened at the knee with the lower part of natural leg concealed, strapped back, bent at the knee.

A further trick includes a device comprising a simulated glove extending at a right angle from a simulated bloody arm stump and having a sleeve through which a person's wrist extends so that the glove is aligned with the persons arm and seems to be worn by the person and with the person's hand, bent back at the wrist, aligned with the stump providing the illusion that a live hand is in fact attached to the stump.

However, none of the prior devices provide the illusory effects of the present invention.

SUMMARY OF THE INVENTION

According to one aspect, the invention provides a simulated finger device comprising a simulated finger; means for releasably mounting the simulated finger on a portion of a finger of a person's hand and concealing the portion so that the simulated finger is aligned with a visible portion of the person's finger appearing to a casual observer to be a natural continuation thereof; and, means attaching the simulated finger to the mounting means for unnatural movement relative thereto providing a fleeting illusion to a casual observer that the person's natural finger is moving unnaturally.

In one embodiment of the invention, the movement permitted by the attaching means is in an axial direction with separation of the simulated finger from the mounting means providing the illusion of separation of the person's natural finger.

In another embodiment, a simulated finger bone is attached to one of the mounting means and the simulated finger so that the movement of the simulated finger exposes the simulated finger bone, preferably with the production of a ratchet noise.

In a further embodiment, the movement permitted by the attaching means is rotational, providing the illusion of rotation of the person's natural finger.

According to another aspect of the invention, a simulated finger device comprises a simulated finger; means for releasably mounting the simulated finger on a portion of a finger of a person's hand and concealing the portion so that the simulated finger is aligned with a visible portion of the person's finger appearing to a casual observer to be a natural continuation thereof; and, means provided on one of the simulated finger and mounting means for performing a function unnatural for a person's finger, providing a fleeting illusion to a casual observer that the person's natural finger has performed the unnatural function. The means for performing the unnatural function may be a whistle which is provided in the simulated finger so that it can be blown by the person on bringing a tip of the simulated finger to lips of the person.

According to a further aspect of the invention, the simulated finger device comprises a ring portion having an rear axial end for releasably receiving a portion of a person's finger in concealing relation; a simulated finger portion; and, means movably mounting the simulated finger portion on a front axial end of the ring portion in alignment with a visible portion of the person's finger as an apparently natural continuation thereof so that movement of the simulated finger portion provides a fleeting illusion to a casual observer of being movement of the person's natural finger.

BRIEF DESCRIPTION OF THE DRAWINGS

Embodiments of the invention will now be described by way of example only and with reference to the accompanying drawings in which.

DESCRIPTION OF PARTICULAR EMBODIMENTS

Figure 1:
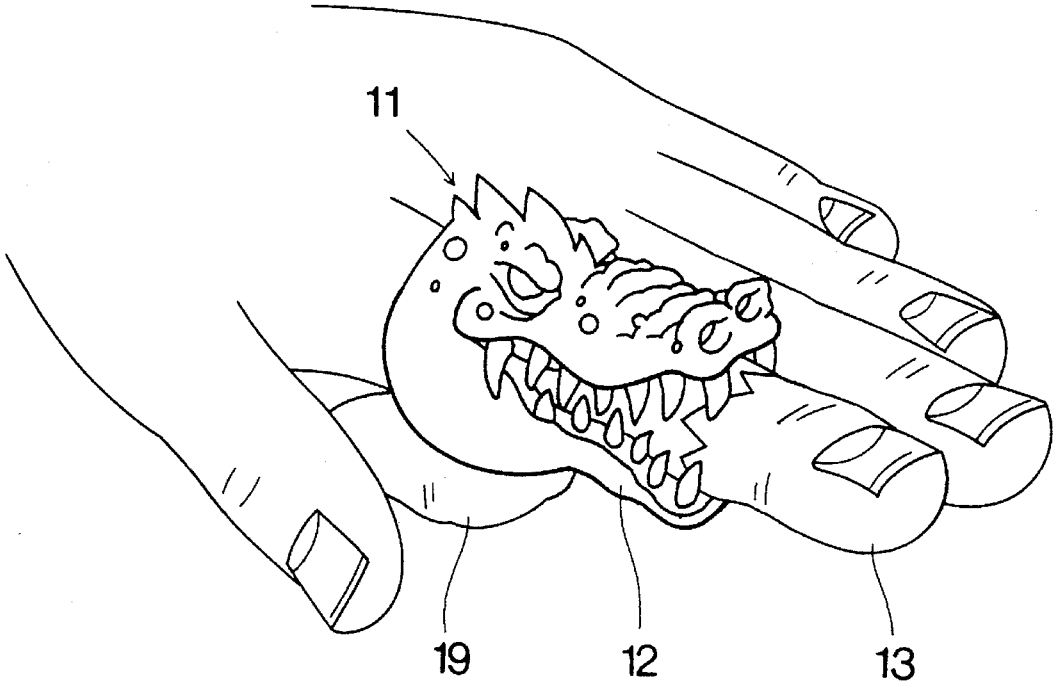
FIG. 1 is a perspective view of a first embodiment of simulated finger device movably mounted on a person's finger and prior to movement thereof.
Figure 2:
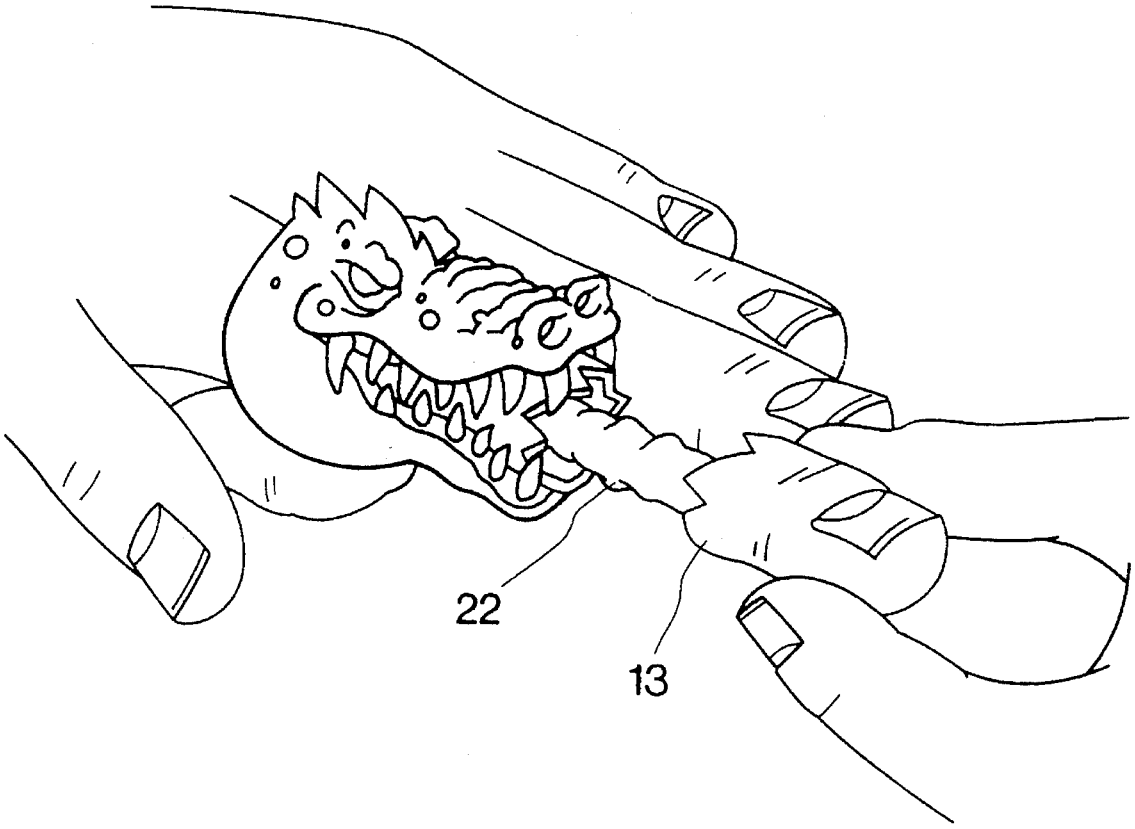
FIG. 2 is a similar view to FIG. 1 but after movement of the device.
Figure 3:
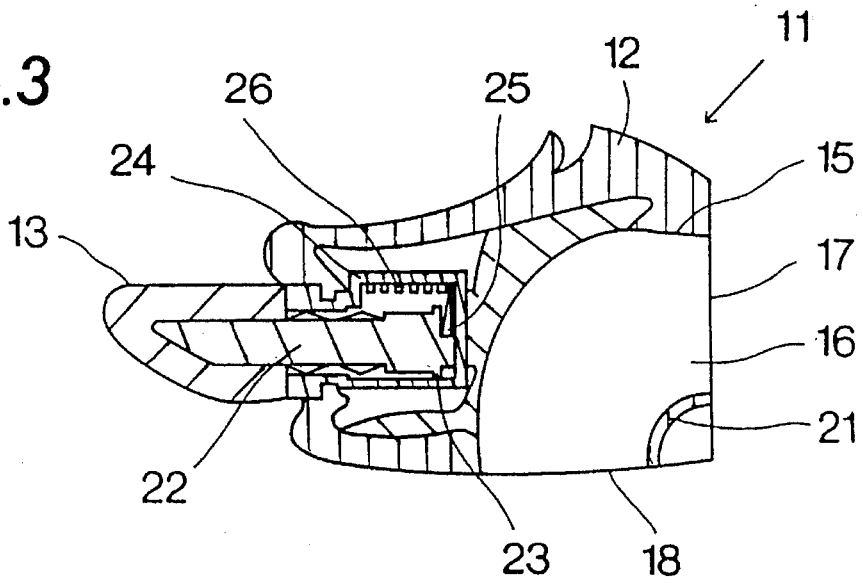
FIGS. 3 and FIG. 4 are, respectively, diagrammatic cross-sectional views taken along a longitudinal axis of the first embodiment and corresponding to the positions shown in FIGS. 1 and 2, respectively.
Figure 4:
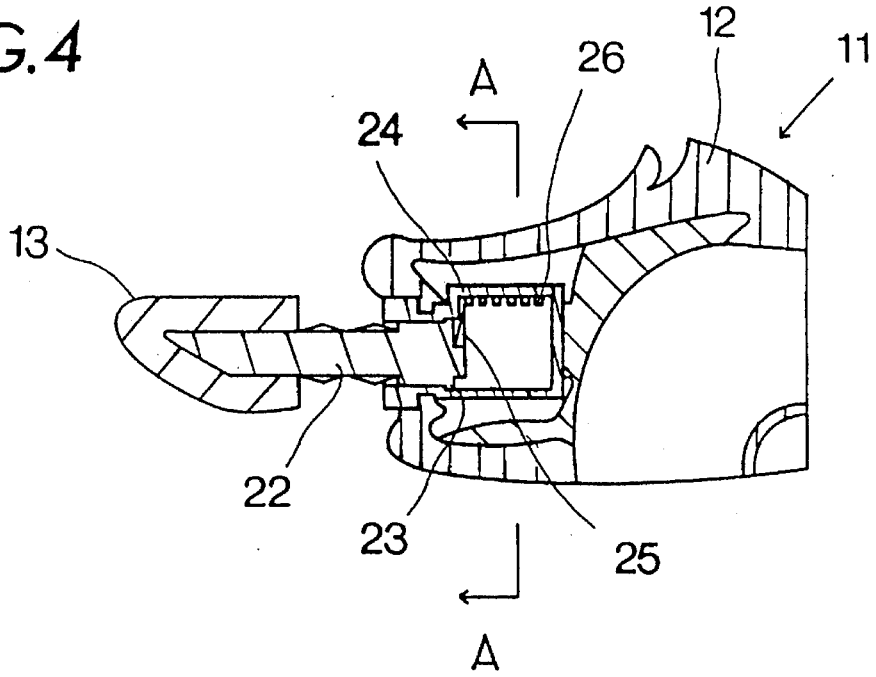
Figure 5:
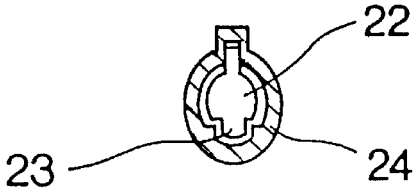
FIG. 5 is a partial cross-sectional view taken along line A—A of FIG. 3.

In the first embodiment shown in FIGS. 1–5, a ring structure 11 carries a stylized head 12 of a grinning crocodile from the open mouth of which extends a simulated finger 13. The ring structure has a generally tubular wall 15 defining a finger receiving socket 16 with a rearward finger entry opening 17 communicating via a bend with a lateral finger exit opening 18 for receiving a person's finger 19, bent around a cross-piece 21 formed between the openings.

The simulated finger carries a rearward extending simulated bone 22 having outwardly protruding flanges 23 at a rear end trapping the simulated finger for reciprocal axial movement in a housing structure 24 which is mounted as a snap fit in the material forming the crocodiles mouth. A resilient "clicking" arm 25 extends radially from the anchoring end and a row of sounding teeth 26 extend axially along the wall of the housing structure.

In operation, the simulated finger device is surreptitiously mounted on the person's finger by crooking the finger through the ring so that the simulated finger provides the illusion to a casual spectator to be a natural extension of the visible portion of the root of the persons natural finger, the mounting and crooked portion being masked by the crocodile motif which also tends to capture and distract the attention of the spectator. Pulling the simulated finger axially to the position shown in FIGS. 2 and 4 reveals the simulated bone, simultaneously emitting a rachet noise as the arm 25 tracks across the teeth 26 providing the fleeting impression, illusion or association of revealing the natural bone of the person's natural finger.

Figure 7:
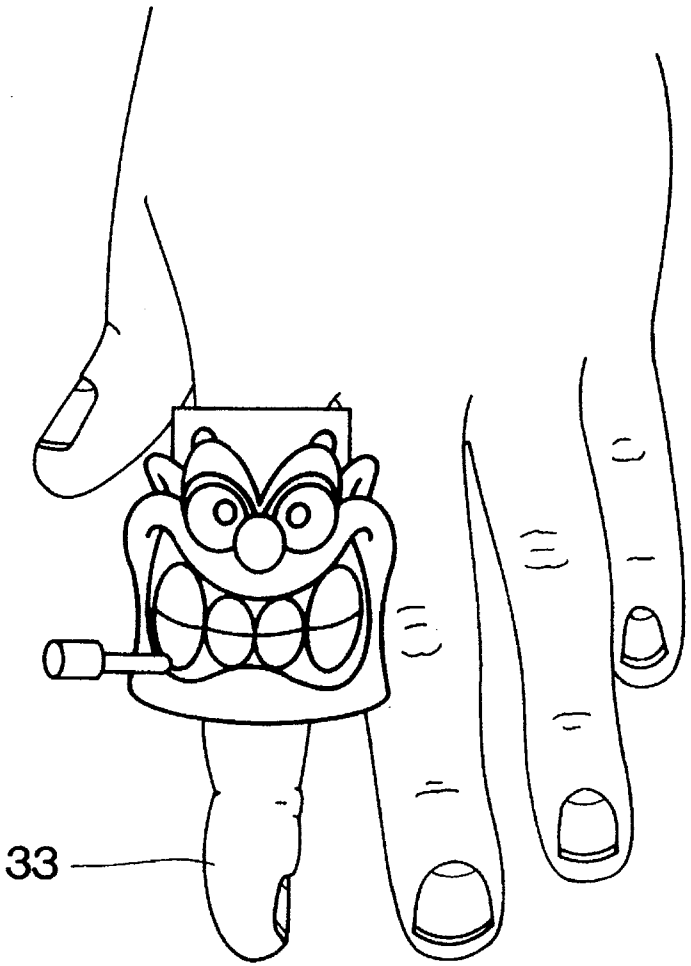
FIG. 7 is a similar view to FIG. 6 but after rotational movement through 90 degrees.
Figure 6:
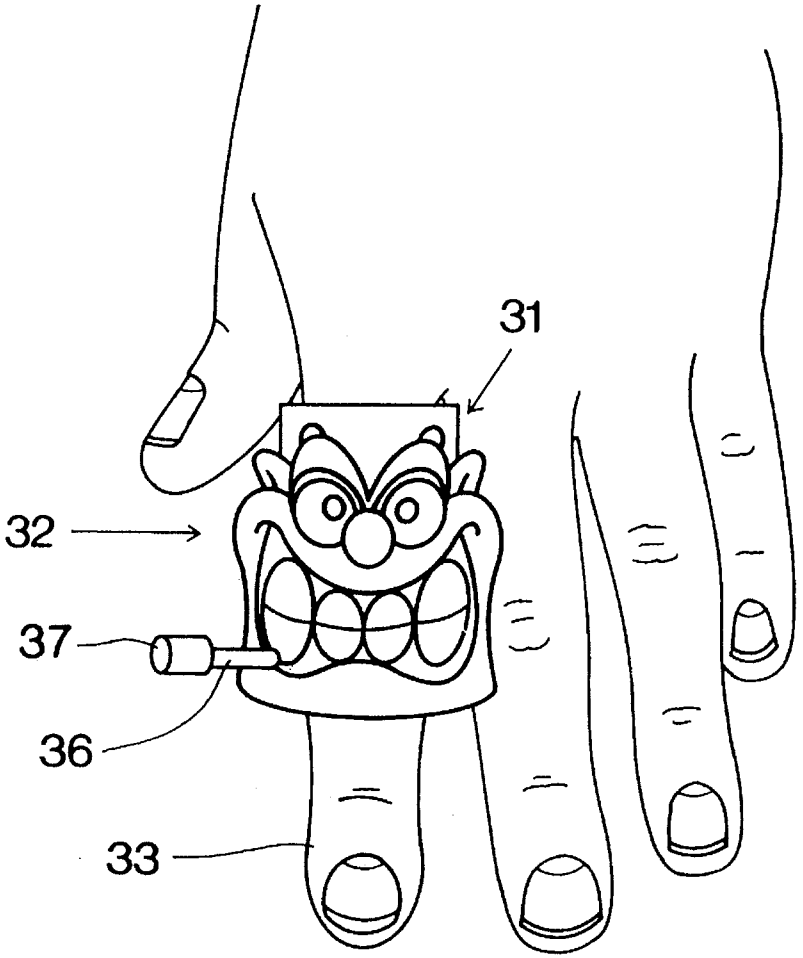
FIG. 6 is an elevational view of a second embodiment of simulated finger device movably mounted on a person's finger and prior to movement thereof.
Figure 8:
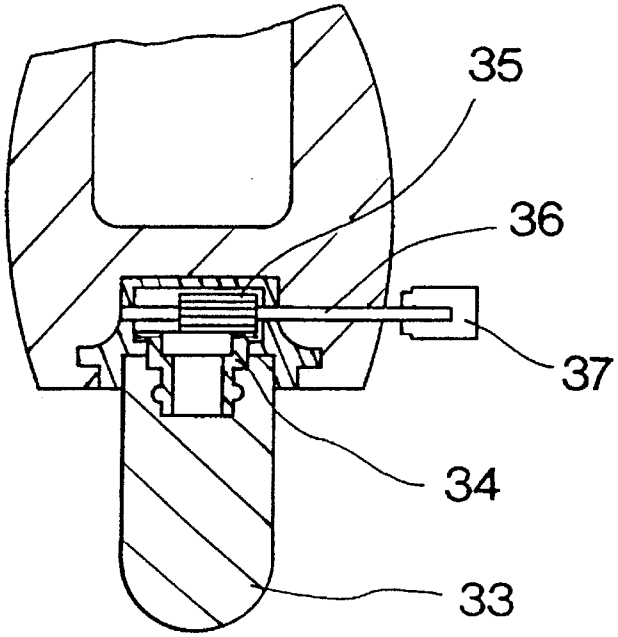
FIG. 8 is a diagrammatic cross-sectional view taken along a longitudinal axis of 7.

In a second example, shown in FIGS. 6–8, a ring structure 31, similar to that of the first embodiment, carries a motif of a gremlins face 32 and the simulated finger 33 is mounted for axial rotation thereon. In particular, as shown in FIG. 8, the simulated finger 33 is mounted on one end of a cup (or bevel) gear 34 meshed with a pinion 35 mounted on one end of a spindle 36 which extends to a finger piece 37 so that rotation of the finger piece causes the gear to rotate the simulated finger from the position of FIG. 6 to that of FIG. 7, providing the illusion or association that the person's natural finger is being rotated. The simulated and motif are made of relatively soft plastic so that the parts can be snap-fitted together.

Figure 10:
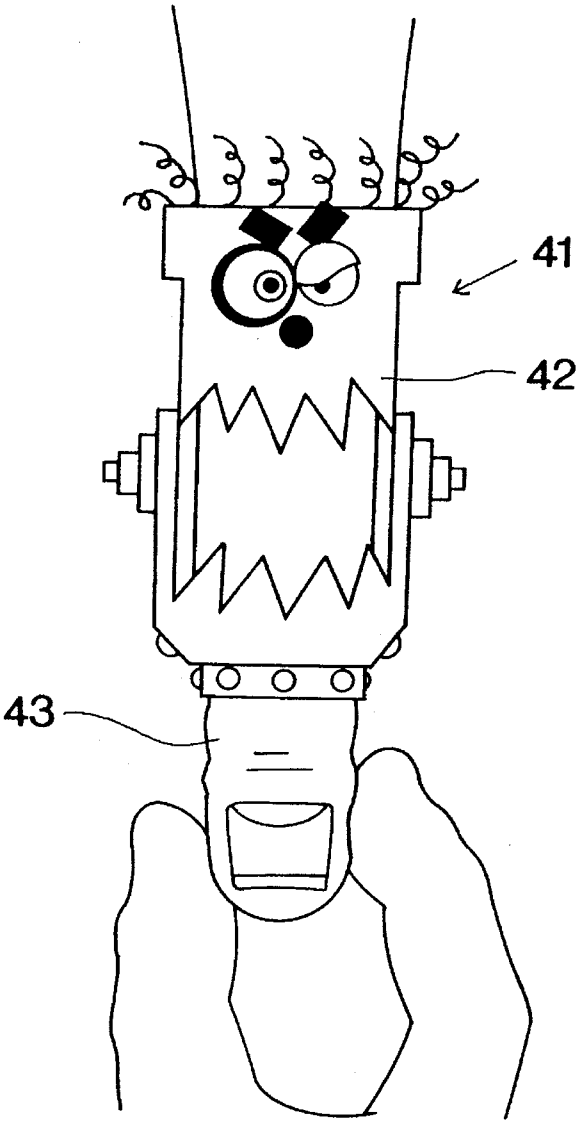
FIG. 10 is an elevational view of the third embodiment of simulated finger device after axial movement thereof.
Figure 9:
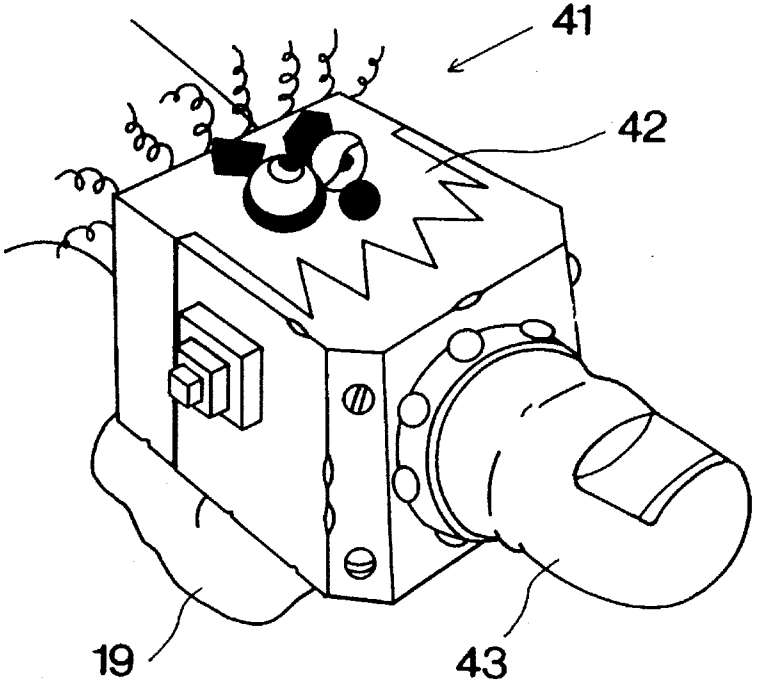
FIG. 9 is a perspective view of a third embodiment of simulated finger device movably mounted on a person's finger and prior to movement thereof.
Figure 12:
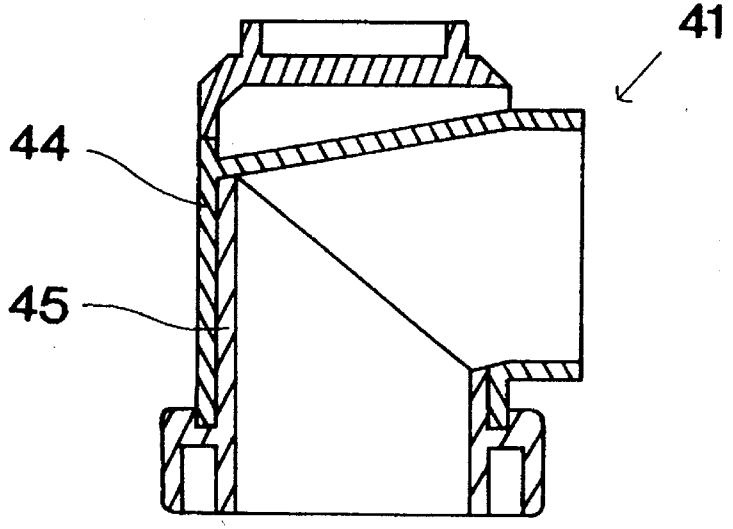
FIGS. 11 and 12 are, respectively, diagrammatic cross-sectional views taken along a longitudinal axis of the third embodiment and in orthogonal planes, corresponding to the position shown in FIG. 9.
Figure 11:
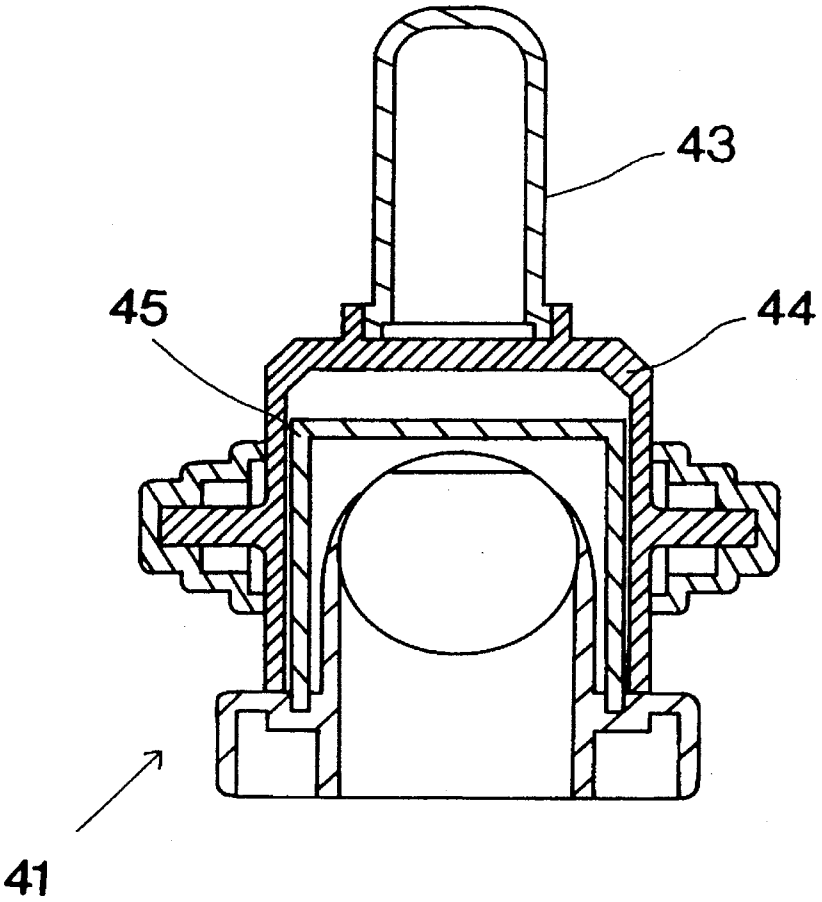
Figure 14:
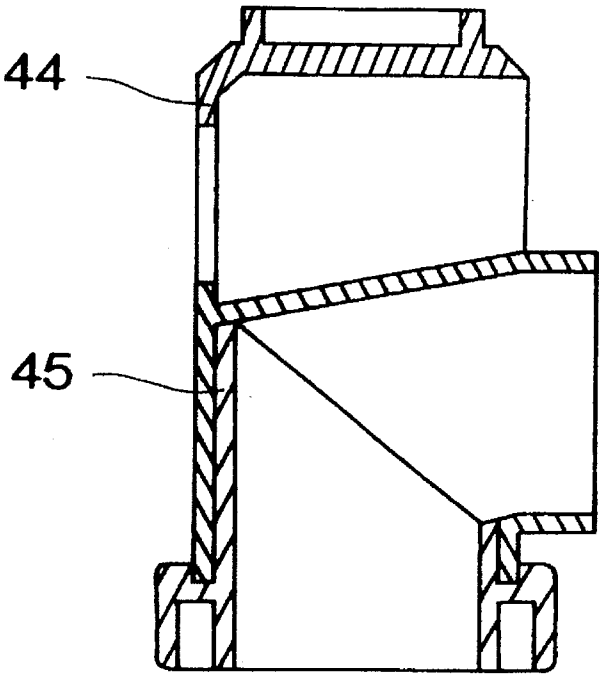
FIGS. 13 and 14 are, respectively, similar views to FIGS. 11 and 12 but corresponding to the position shown in FIG. 10.
Figure 13:
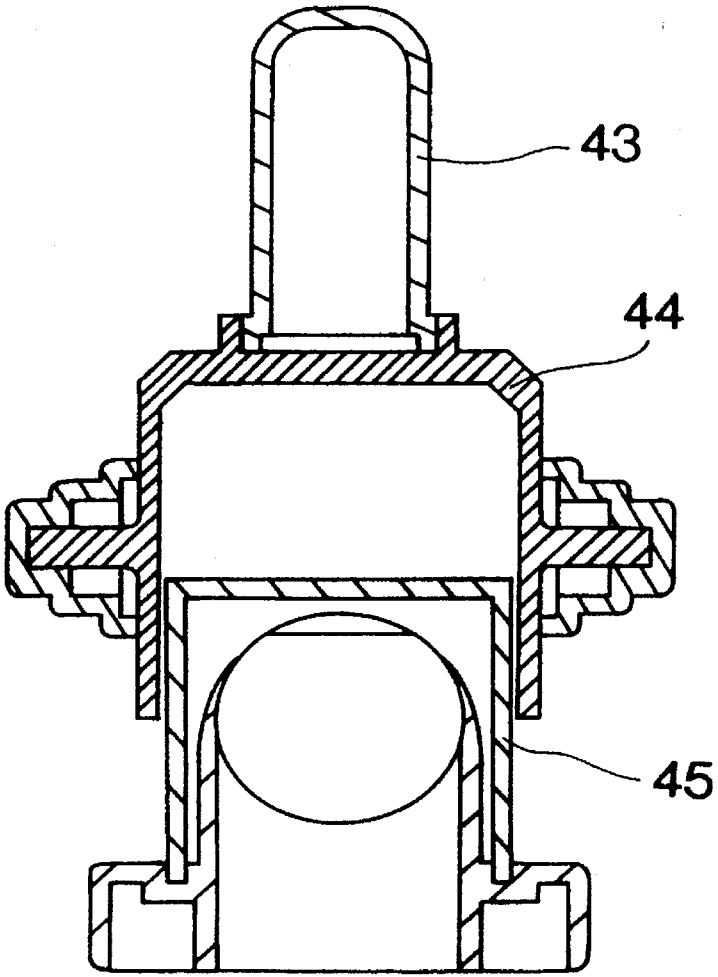

In the third example, shown in FIGS. 9–15, the ring structure 41 carries a robot like motif 42 and the simulated finger 43 extends from on outer casing 44 mounted for axial reciprocal sliding movement between stops (not shown) on an inner casing 45 so that pulling the finger opens the mouth of the robot, as shown in FIGS. 10, 13 and 14. A conventional sound producing mechanism or "screecher" (not shown) may be incorporated in the casing for simultaneous operation with simulated finger movement. Again the fleeting illusion or association with the person's natural finger being separated is provided.

Figure 15:
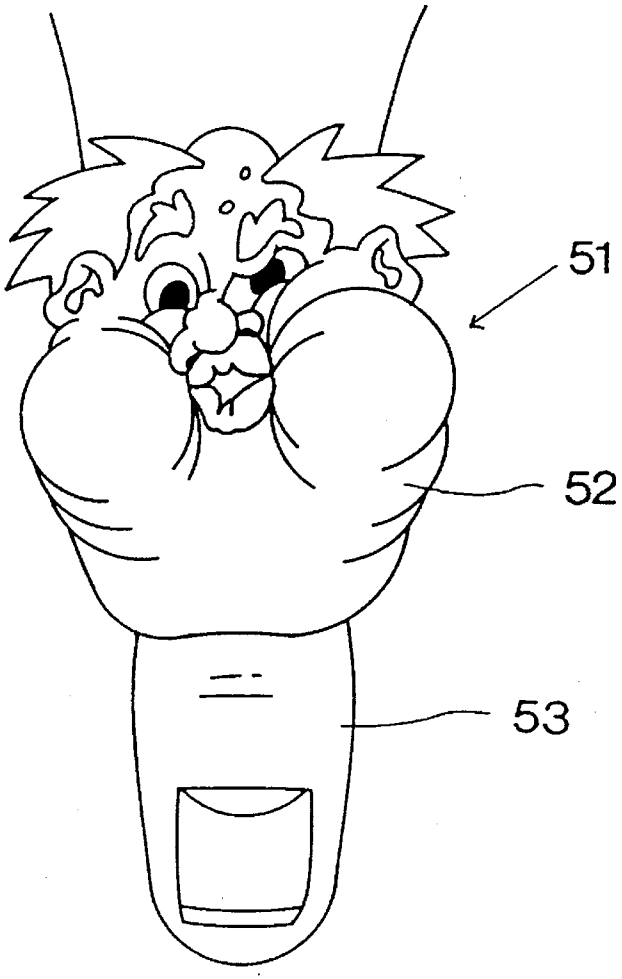
FIG. 15 is a perspective view of a fourth embodiment of simulated finger device mounted on a person's finger.
Figure 17:
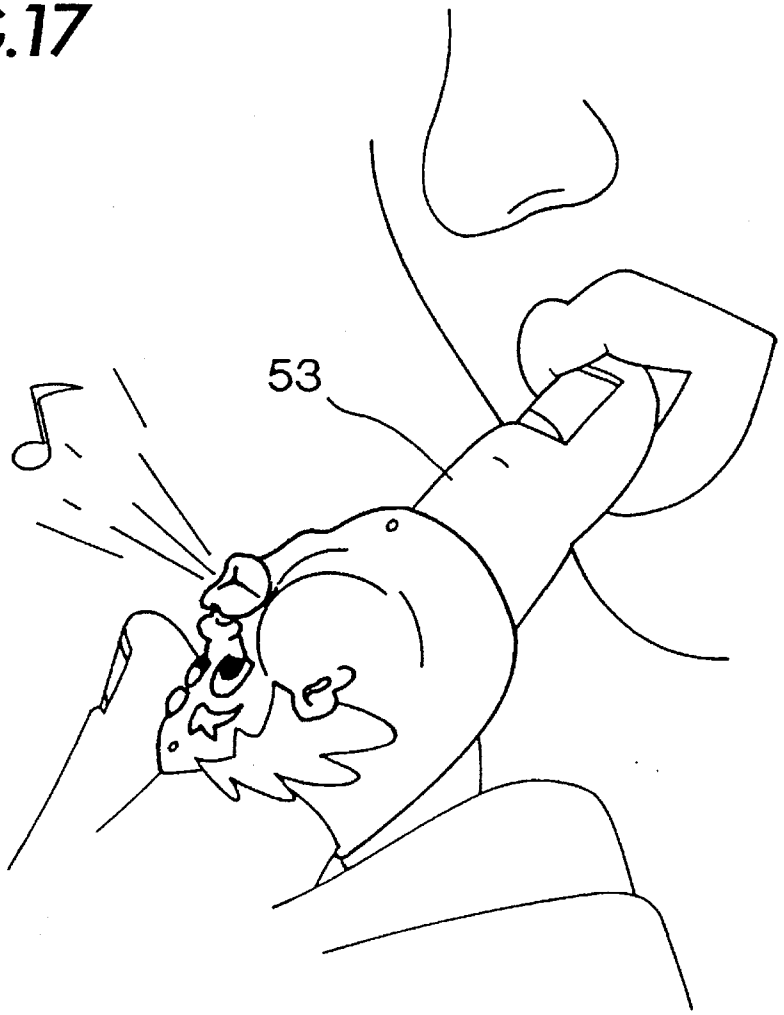
Figure 16:
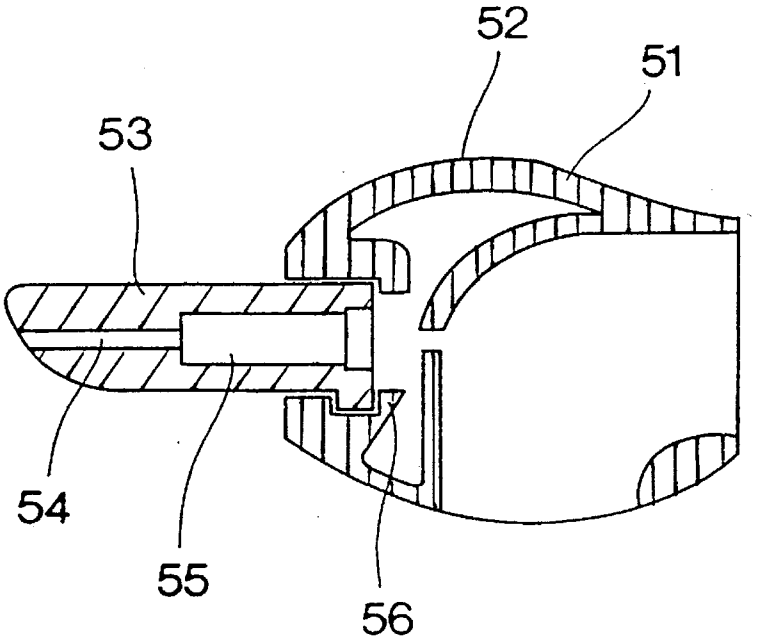
FIG. 16 is a diagrammatic cross-sectional view taken along a longitudinal axis of 14; and, FIG. 17 is a perspective view of a fourth embodiment of simulated finger device mounted on a person's finger and held to a person's lips to sound the whistle thereof.

In a fourth example, shown in FIGS. 15–17, the ring structure 51 carries the motif 52 of a caricature of a fat man's face, puffing or blowing, and the simulated finger 53 incorporates a whistle structure having an axially extending air tube 54 passing a reed (not shown) in a counter-bore 55 so that a loud whistle can be sounded simply by holding the end of the simulated finger to a person's lips and blowing as shown in FIG. 17. As shown in FIG. 16, The simulated finger is mounted as a snap fit in the ring structure by resilient flexure of arm portions 56, integrally formed therewith.

It should be understood that the devices described could be mounted on a person's thumb and the term finger as used throughout the claims is intended to include the thumb.

I claim:

1. A simulated finger amusement device comprising a simulated finger having an appearance that closely resembles a free end portion of a human finger; means for releasably mounting the simulated finger on a portion of a finger of a person's hand at a location spaced from a free end and concealing one side of the portion which is at the location spaced from the free end so that the simulated finger may be aligned with a visible portion of the person's finger, appearing to a casual observer to be a natural continuation thereof; and, means attaching the simulated finger to the mounting means for rotational movement about a longitudinal axis of the simulated finger providing an illusion to a casual observer that the person's natural finger is rotating unnaturally.

2. A simulated finger amusement device according to claim 1 in which the mounting means includes a wall portion defining a cavity for receiving the concealed portion of the person's finger, bent at a finger joint.

3. A simulated finger amusement device according to claim 2 in which the wall portion is tubular having a tube axis and an axially rearward, finger entry opening and is further formed with a lateral, finger exit opening which extends transversely of the tube axis and through which a bent tip of the person's finger can exit from the cavity, concealed from the casual observer.

4. A simulated finger amusement device according to claim 1 in which the mounting means includes an outer masking portion and a finger locating portion extending behind the masking portion whereby the concealed portion of the person's finger can be received between the masking portion and the finger locating portion and crooked around the finger locating portion thereby to mount the simulated finger thereon.

5. A simulated finger amusement device comprising a simulated finger with a first end having an appearance that closely resembles a free end portion of a human finger and a second opposite end; means for releasably mounting the simulated finger on a portion of a finger of a person's hand and concealing the portion so that the simulated finger may be aligned with a visible portion of the person's finger appearing to a casual observer to be a natural continuation thereof; and, means provided on one of the simulated finger and mounting means for performing a function unnatural for a person's finger, providing an illusion to a casual observer that the person's natural finger has performed the unnatural function said opposite end of the simulated finger being disposed inside and surrounded by said means for mounting.

6. A simulated finger device according to claim 5 in which the means for performing the unnatural function is a whistle which is provided in the simulated finger so that it can be blown by the person on bringing a tip of the simulated finger to lips of the person.

7. A simulated finger amusement device comprising a ring portion having an rear axial end for releasably receiving a portion of a person's finger in concealing relation; a simulated finger portion with a first end, having an appearance that closely resembles a free end portion of a human finger and a second opposite end; and, means for movably mounting the simulated finger portion on a front axial end of the ring portion so that the simulated human finger may be aligned with a visible portion of the person's finger as an apparently natural continuation thereof so that movement of the simulated finger portion provides an illusion to a casual observer of being movement of the person's natural finger said opposite end of the simulated finger being disposed inside and surrounded by said ring portion.

8. A simulated finger device according to claim 7 in which the movement permitted by the movably mounting means is in an axial direction with separation of the simulated finger from the mounting means so that the person's finger appears to separate.

9. A simulated finger amusement device according to claim 7 in which the movement permitted by the movably mounting means is rotational so that a tip of the person's finger appears to rotate.

10. A simulated finger device according to claim 8 including a simulated finger bone attached to one of the mounting means and the simulated finger so that movement of the simulated finger exposes the simulated finger bone which appears to be a natural bone of the person's finger.

11. A simulated finger amusement device according to claim 7 in which the ring portion has a tubular wall portion with an axially rearward, finger entry opening and is further formed with a lateral, finger exit opening through which a tip of the person's finger can exit from the cavity, concealed from the casual observer.

12. A simulated finger device according to claim 7 including means to produce an appropriate sound during movement of the simulated finger.

13. A simulated finger amusement device comprising a simulated finger with a first end having an appearance that closely resembles a free end portion of a human finger and a second opposite end; means contiguous with one side of the simulated finger for releasably mounting the simulated finger on a person's finger at a location between a knuckle end and a free end thereof so that one side of a portion of the person's finger which extends between the location and the knuckle end is visible and a same side of a remainder of the person's finger is concealed from view so that the simulated finger may be aligned with the visible portion of the person's finger appearing to a casual observer to be a natural continuation thereof; and, means attaching the simulated finger to the mounting means for movement relative thereto providing an illusion to a casual observer that the person's natural finger is moving unnaturally said opposite end of the simulated finger being disposed inside and surrounded by said mounting means.

14. A simulated fineger device according to claim 13 including means to produce an appropriate sound during movement of the simulated finger.

* * * * *